US005611434A

United States Patent [19]

Veh et al.

[11] Patent Number: 5,611,434

[45] Date of Patent: Mar. 18, 1997

[54] ROTOR FOR A SCREEN GRADER

[75] Inventors: Gerhard Veh, Hochstadt; Jurgen Oerter, Heidenheim, both of Germany

[73] Assignee: Voith Sulzer Stoffaufbereitung GmbH, Ravensburg, Germany

[21] Appl. No.: 373,551

[22] Filed: Jan. 17, 1995

[30] Foreign Application Priority Data

Jan. 18, 1994 [DE] Germany ..... 44 01 305.1

[51] Int. Cl.[6] ..... B07B 1/20

[52] U.S. Cl. ..... 209/273; 209/306; 162/380

[58] Field of Search ..... 209/268, 270, 209/273, 306; 162/380

[56] References Cited

U.S. PATENT DOCUMENTS

| | | | |
|---|---|---|---|
| 727,878 | 5/1903 | Baker et al. | 209/273 |
| 799,434 | 9/1905 | Baker et al. | 209/306 X |
| 1,134,304 | 4/1915 | Westbye | 209/273 |
| 1,774,644 | 9/1930 | Gesnel | 209/306 X |
| 1,856,176 | 5/1932 | Trimbey | 209/306 X |
| 1,973,864 | 9/1934 | Biffar | 209/273 |
| 3,953,325 | 4/1976 | Nelson | 209/273 |
| 3,970,548 | 7/1976 | Seifert et al. | 209/306 X |
| 4,585,551 | 4/1986 | Musselmann | 209/379 |
| 4,601,819 | 7/1986 | Pellhammer et al. | 209/273 |
| 4,680,108 | 7/1987 | Ahs . | |
| 5,071,543 | 12/1991 | Rajala | 162/380 X |

FOREIGN PATENT DOCUMENTS

| | | | |
|---|---|---|---|
| 0404624 | 12/1990 | European Pat. Off. . | |
| 3217824 | 11/1983 | Germany . | |
| 23861 | 10/1913 | Norway | 209/306 |

*Primary Examiner*—David A. Bucci
*Assistant Examiner*—Scott L. Lowe
*Attorney, Agent, or Firm*—Baker & Daniels

[57] ABSTRACT

The invention concerns a rotor with impulse elements running in the vicinity of a rotationally symmetric screen basket and with blade elements which are run radially within the impulse elements with or by the rotor, notably for use in screen graders. The invention is characterized in that a pump impeller is formed by the mutual coordination and design of the blade elements.

13 Claims, 2 Drawing Sheets

ROTOR FOR A SCREEN GRADER

BACKGROUND OF THE INVENTION

The invention concerns a rotor for use in screen graders having pulse and blade elements running in a screen basket. Such rotor is known from European Patent Document No. EP 0 404 624. The purpose of EP 0 404 624 is to impart a tangential or peripheral velocity to the suspension being graded which varies from the peripheral velocity of the impulse elements. According to such document, this is accomplished in that the radially outer edges of the blades are on a radius smaller than that of the impulse elements.

SUMMARY OF THE INVENTION

According to the invention, it has been recognized that a much more significant effect can be achieved with the solution according to the present invention, on which the following comments are submitted.

Measurements and fluidic calculations performed on the screen basket pressure grader described above have shown the following:

contained in the area of the upper grading zone are locations of a lower screen pass velocity;

prevailing in the area of the drain for the accepted portion of the suspension being graded, which is situated at the end of the grading zone, are very high screen pass velocities;

a deckering process from the top down is taking place.

Most variations in screen pass velocities and flow conditions occur on the screen basket between these two extreme points, both across the height and the periphery of the screen basket.

Reliability

The peripheral speed of the rotor needs to be set to correspond to the zones of highest screen pass velocities such that a sufficient screen passage is guaranteed in the screen zones where the highest screen pass velocity prevails. As a result, an unnecessarily high rotor effect exists in the areas of low screen pass velocity.

In other words, when the rotor is set at high enough speeds to accommodate the zones of highest screen pass velocities, the rotor is moving too fast with respect to areas of lower screen pass velocities. Conversely, when screen pass velocities are more uniform across the height of the screen, lower rotor speeds are needed (thus, less energy is required) or a higher average screen pass velocity can be achieved.

Grading Effect

Varying screen pass velocity also results in a variation in grading integrity. The separating efficiency of the machine also drops with a rising average screen pass velocity. Therefore an optimum grading effect can be achieved on the screen only with uniform velocities.

Clogging Problem

High screen pass velocities favor clogging. Additionally, a broad range of screen pass velocities involves the risk of clogging, because the rotor peripheral speed needs to be chosen unnecessarily high, in order to accommodate such nonuniform velocities.

Accumulation Problem

Accumulations can form in the space corresponding to the accepted portion of the graded suspension at points of low flow velocity or in zones of stagnant flow. This is particularly critical when the grader precedes a paper machine, because such accumulations, e.g., lumps, can cause holes and web breaks in the resultant paper web.

It should be noted also that the invention avoids these drawbacks by achieving a screen throughput—across its height—at a uniform approach flow velocity.

BRIEF DESCRIPTION OF THE DRAWINGS

The invention will be more fully explained hereafter with the aid of the drawing figures, wherein.

Corresponding reference characters indicate corresponding parts throughout the several views. The exemplifications set out herein illustrate preferred embodiments of the invention and such exemplifications are not to be construed as limiting the scope of the invention in any manner.

DETAILED DESCRIPTION OF THE INVENTION

Figure 1:
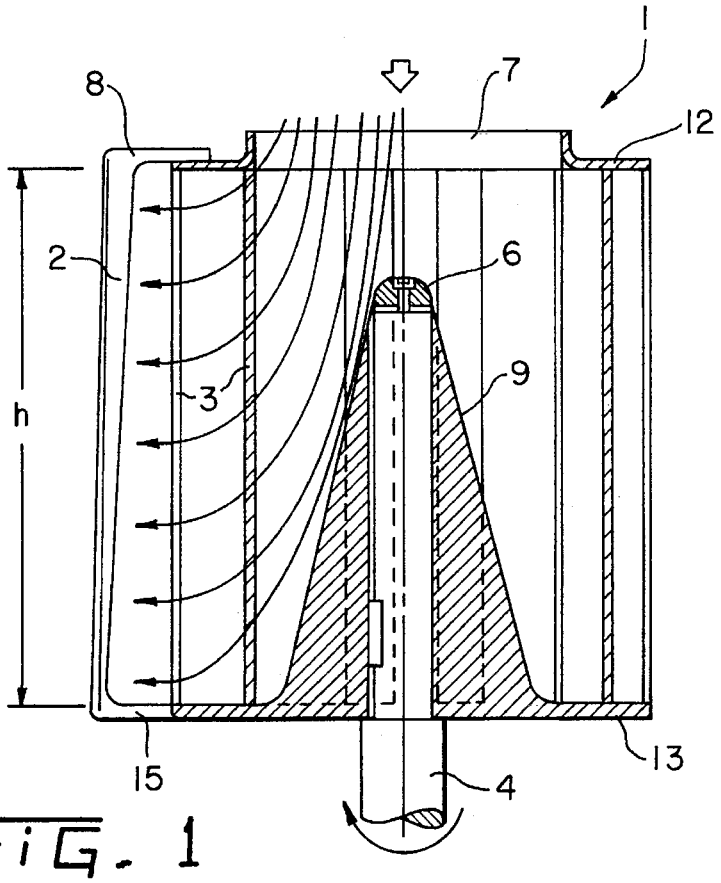
FIG. 1 is an axial section taken on line I—I of FIG. 2 showing a first rotor style.
Figure 2:
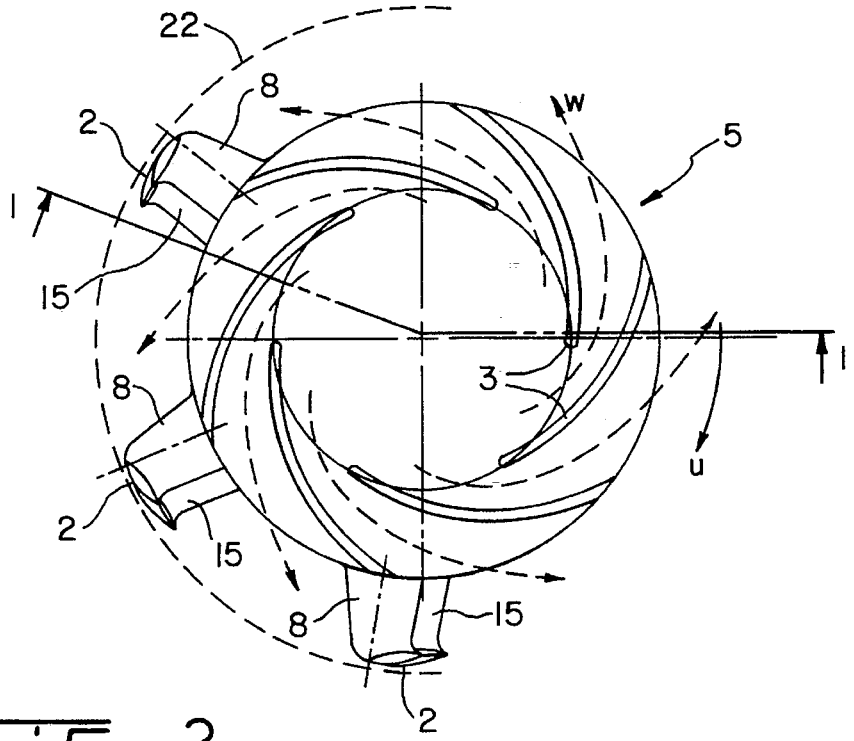
FIG. 2 is a plan view of same.

According to FIGS. 1 and 2, the rotor 1 features impulse elements 2 which closely sweep along the screen 22 and, in cross section, may have an airfoil profile, as can be seen in FIG. 2. These airfoils or wings are held on the rotor with holders 15 and 8. Impulse elements 2 generate pulses for grading the suspension, preferably for grading small fibers of paper or cellulose, and for keeping the screen 22 clear of residue or fiber accumulations or specks, as these are called at times. The rotor 1 is secured to a shaft 4 by means of a holder 6. Located radially within the impulse elements 2 are blade elements 3 which have a shape corresponding to the rearward curving blades of a radial water pump. An influx of a suspension to be graded axially enters the apparatus through influx opening 7 as shown by the heavy arrow and the lighter flow lines. Obtained thereby is a constant approach flow velocity of the fiber particles in radial direction on the screen 22 across the height h of the impulse elements 2 and the screen 22. In the present case, a part 9 having a truncated cone shape is additionally provided as rotor hub, for a favorable flow control. Blades 3 are retained on flanges 12 and 13 of the hub. In FIG. 2, u indicates the peripheral speed of the rotor, and w indicates the velocity of the particles through the pump impeller 5.

In accordance with the constant velocity w across the screen height h, a constant throughput is obtained relative to the screen height.

Figure 3:
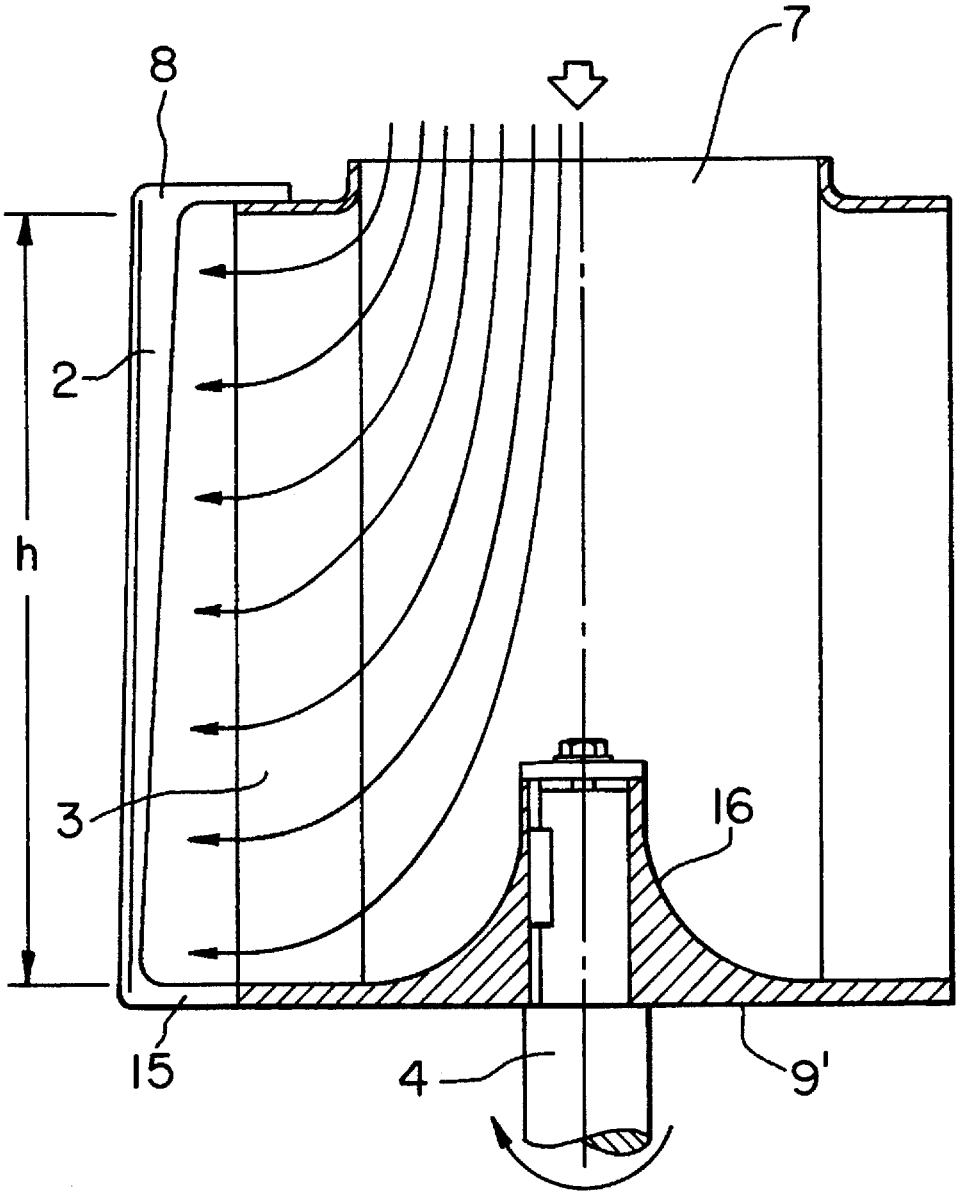
FIG. 3 illustrates another embodiment of the rotor in axial section.

In FIG. 3 the rotor is fashioned similarly as regards the blades 3 and impulse elements 2, but has a shallower hub 9' with a favorable, rounded flow control surface 16.

The delivery head of the pump 5 is preferably chosen at about 0.1 to 15 m, more preferably about 0.3 m. Such delivery head pressures may be imparted to the suspension by a pumping device such as a pump wheel if the suspension passes through such a pumping device before the suspension enters the pressure grader. Otherwise, the dimensioning of a pump, here notably of the pump blades 3, can be in accordance with the trade literature.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rotor for a screen grader of the type having a rotationally symmetric screen basket with a screening profile for grading a suspension and a shaft having a rotor axis, said rotor comprising:

a rotor hub rotatably mounted on the shaft;

a plurality of impulse elements disposed within and proximal to the rotationally symmetric screen basket, wherein each impulse element is connected to the rotor hub, wherein each impulse element has a height corresponding to the height of the screen basket, and wherein rotation of the impulse elements within the screen basket generates pulses for grading the suspension; and a plurality of rearward curving blade elements connected to the rotor hub and having outer blade edges which are disposed radially within and spaced apart from said impulse elements, wherein each blade has a height corresponding to the height of the screen basket, the design and mutual coordination of said blade elements forming a pump impeller for achieving a uniform radial flow of the suspension across the height of the screen.

2. A rotor according to claim 1 wherein said blade elements extend parallel to the rotor axis.

3. A rotor according to claim 1 wherein said pump impeller is a radial wheel.

4. A rotor according to claim 1 wherein said blade elements forming the pump are configured for a delivery head between 0.1 and 15 m.

5. A rotor according to claim 1 wherein said blade elements are fashioned as blades curving rearwardly relative to the direction of rotation.

6. A rotor according to claim 1 having a fluid discharge angle adapted to the profile of said screen basket.

7. A rotor according to claim 1 wherein said blade elements are configured for a delivery head of about 0.3 m.

8. A rotor according to claim 1, wherein each impulse element has major opposing faces, one of such faces being disposed outward toward the screen basket and the other of said faces being disposed inward toward the rotor axis of the shaft.

9. A rotor according to claim 1, wherein the rotor hub is cone-shaped.

10. A grader of the type having a rotationally symmetric screen basket with a screening profile for grading a fiber suspension and a shaft having a rotor axis and having a rotor rotatably disposed on the rotor axis within the screen basket, said rotor comprising:

a rotor hub rotatably mounted on the shaft;

a plurality of impulse elements disposed within and proximal to the rotationally symmetric screen basket, wherein each impulse element is connected to the rotor hub, wherein each impulse element has a height corresponding to the height of the screen basket, and wherein rotation of the impulse elements within the screen basket generates pulses for grading the suspension; and a plurality of rearward curving blade elements connected to the rotor hub and having outer blade edges which are disposed radially within and spaced apart from said impulse elements, wherein each blade has a height corresponding to the height of the screen basket, the design and mutual coordination of said blade elements forming a pump impeller for achieving a uniform radial flow of the suspension across the height of the screen.

11. A grader according to claim 10, wherein the grader further comprises an influx opening through which an influx enters the grader, wherein the influx opening is in flow communication with the impulse elements and blade elements.

12. A grader according to claim 10, wherein each impulse element has major opposing faces, one of such faces being disposed outward toward the screen basket and the other of said faces being disposed inward toward the rotor axis of the shaft.

13. A grader according to claim 10, wherein the rotor hub is cone-shaped.

* * * * *